US011559728B2

(12) United States Patent
Martell

(10) Patent No.: US 11,559,728 B2
(45) Date of Patent: Jan. 24, 2023

(54) GOLF BAG CONVERTIBLE STRAP ASSEMBLY

(71) Applicant: KARSTEN MANUFACTURING CORPORATION, Phoenix, AZ (US)

(72) Inventor: James D. Martell, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 17/643,092

(22) Filed: Dec. 7, 2021

(65) Prior Publication Data

US 2022/0096903 A1 Mar. 31, 2022

Related U.S. Application Data

(63) Continuation of application No. 16/888,338, filed on May 29, 2020, now Pat. No. 11,192,008.

(60) Provisional application No. 63/001,673, filed on Mar. 30, 2020, provisional application No. 62/855,747, filed on May 31, 2019.

(51) Int. Cl.

| | |
|---|---|
| ***A45F 3/04*** | (2006.01) |
| ***A63B 55/00*** | (2015.01) |
| ***A45C 13/30*** | (2006.01) |

(52) U.S. Cl.

CPC ..... *A63B 55/408* (2015.10); *A45C 13/30* (2013.01); *A45F 3/04* (2013.01)

(58) Field of Classification Search

CPC ... Y10S 24/3412; A63B 55/408; A63B 55/00; A45F 3/04; A45F 3/14; A45F 3/047; A41F 15/02; A44B 11/02; Y10T 24/3412

USPC ..... 224/578–579

See application file for complete search history.

(56) References Cited

U.S. PATENT DOCUMENTS

| | | | | |
|---|---|---|---|---|
| 4,757,927 | A | 7/1988 | Rutty | |
| 5,873,506 | A * | 2/1999 | Golling | A45F 3/02 224/655 |
| 6,006,974 | A | 12/1999 | Varney et al. | |
| 6,131,783 | A | 10/2000 | Maeng | |
| 6,152,342 | A * | 11/2000 | Suk | A63B 55/408 224/259 |
| 6,168,060 | B1 | 1/2001 | Mayers | |
| 6,283,350 | B1 | 9/2001 | Gottmeirer | |

(Continued)

FOREIGN PATENT DOCUMENTS

TW M300990 U 11/2006

OTHER PUBLICATIONS

Rick V.; Titleist Gear Spotlight: New Players Collection Stand Bags, Apr. 12, 2017; https://www.titleist.com/teamtitleist/b/tourblog/posts/titleist-gear-spotlight-new-players-collection-stand-bags, accessed Sep. 22, 2020.

(Continued)

*Primary Examiner* — Adam J Waggenspack

(57) ABSTRACT

Embodiments of a strap assembly system for a golf bag are described herein. The strap assembly system can be converted between a single-strap configuration or a double-strap configuration. The strap assembly system comprises a first strap, a second strap, and a back puck. The back puck comprises first and second attachment openings for securing the first strap. The back puck further comprises first and second side openings that define a linear pathway and are configured to receive the second strap. The second strap can move freely along the linear pathway.

20 Claims, 7 Drawing Sheets

(56) References Cited

U.S. PATENT DOCUMENTS

| | | | | |
|---|---|---|---|---|
| 6,457,620 | B1 | 10/2002 | Batten | |
| 6,460,747 | B1 | 10/2002 | Tuerschmann | |
| 6,530,129 | B1 | 3/2003 | Cheng | |
| 10,245,486 | B2 | 4/2019 | Burgess | |
| 10,610,002 | B2 * | 4/2020 | Pacha | A45F 3/04 |
| 2002/0088836 | A1 | 7/2002 | Batten et al. | |
| 2010/0170065 | A1 * | 7/2010 | Paik | A44B 11/04 24/163 R |
| 2010/0293758 | A1 | 11/2010 | Shiao | |
| 2013/0075289 | A1 | 3/2013 | Herron et al. | |
| 2014/0140784 | A1 | 5/2014 | Vick et al. | |
| 2015/0136825 | A1 * | 5/2015 | Kalck | A63B 55/00 224/653 |
| 2017/0266522 | A1 | 9/2017 | Burgess et al. | |
| 2018/0093146 | A1 | 4/2018 | Bruce et al. | |
| 2019/0029403 | A1 | 1/2019 | Pacha et al. | |

OTHER PUBLICATIONS

Sun Mountain; Womens 3.5Ls Stand/Carry Bag; https://shop.sunmountain.com/wmn-3-5-Is-bag-25490-detail, accessed Sep. 22, 2020.

Int'l Search Report and Written Opinion from corresponding PCT appl. No. PCT/US2020/035400, filed on May 29, 2020.

* cited by examiner

GOLF BAG CONVERTIBLE STRAP ASSEMBLY

RELATED APPLICATIONS

This is a continuation of U.S. patent application Ser. No. 16/888,338 filed on May 29, 2020, which claims the benefit to U.S. Provisional Patent Application No. 62/855,747, filed on May 31, 2019, and U.S. Provisional Patent Application No. 63/001,673, filed on Mar. 30, 2020, both of which are incorporated herein by reference.

FIELD

The present disclosure relates generally to golf equipment, and more particularly, to a strap assembly for a carry bag.

BACKGROUND

Typically, golf bags are categorized into carry bags and cart bags. Carry bags generally comprise a strap system that allows the user carry the weight of the bag on their shoulders. In some carry bags, the strap system is a single strap system that allows the user to carry the bag on one side of their body. In other carry bags, the strap system is a double-strap system that allows the user to wear the bag like a backpack.

Carry bags are typically designed with either a single strap system or a double-strap system. Single strap systems have the drawback of tiring out a user's upper body and shoulder due to the uneven weighting, which can inhibit their performance on the golf round. Double-strap systems overcome this by providing the user with the option of evenly distributing the weight of the golf bag across both shoulders, which leads to less overall fatigue. However, for short distances golfers sometimes prefer the convenience of a single strap system. Additionally, caddies who are carrying two bags cannot use both straps on a double-strap bag but must instead carry the bags by placing a single strap from each bag on each shoulder.

The double-strap systems often have crisscrossing straps that are worn like a backpack. In some double-strap designs, the bag can be lifted by one strap and carried at the right side of the user's body. However, the orientation of the double-strap designs prevents the user from conveniently using a single strap on the left side of the user's body. The strap is not configured to distribute the weight of the bag accurately when the bag is carried on the left side of the user's body. Additionally, regardless of which side of the body the bag is carried on, double-strap systems do not function well for single strap carrying because the straps are fixed to each other at a crisscrossing intersection. The intersection can run into the user's elbow when the user is picking up the bag by a single strap. In view of these issues, there is a need in the art for a strap system that is convertible between a double-strap system into a single strap system and vice versa.

DESCRIPTION

The invention described herein is a convertible strap system for a golf bag. The strap system can be convertible between a single-strap configuration and a double-strap configuration. The strap system can comprise a first strap 102, a second strap 108, and a back puck 100. The back puck 100 can orient the first strap 102 and the second strap 108 in relation to each other in the double-strap configuration. The first strap 102 can be permanently engaged with the back puck 100, whereas the second strap 108 can be removably engaged with the back puck 100. In the single-strap configuration, the second strap 108 can be disengaged with the back puck 100. In the double-strap configuration, the second strap 108 can be translationally engaged with the back puck 100.

Figure 1:
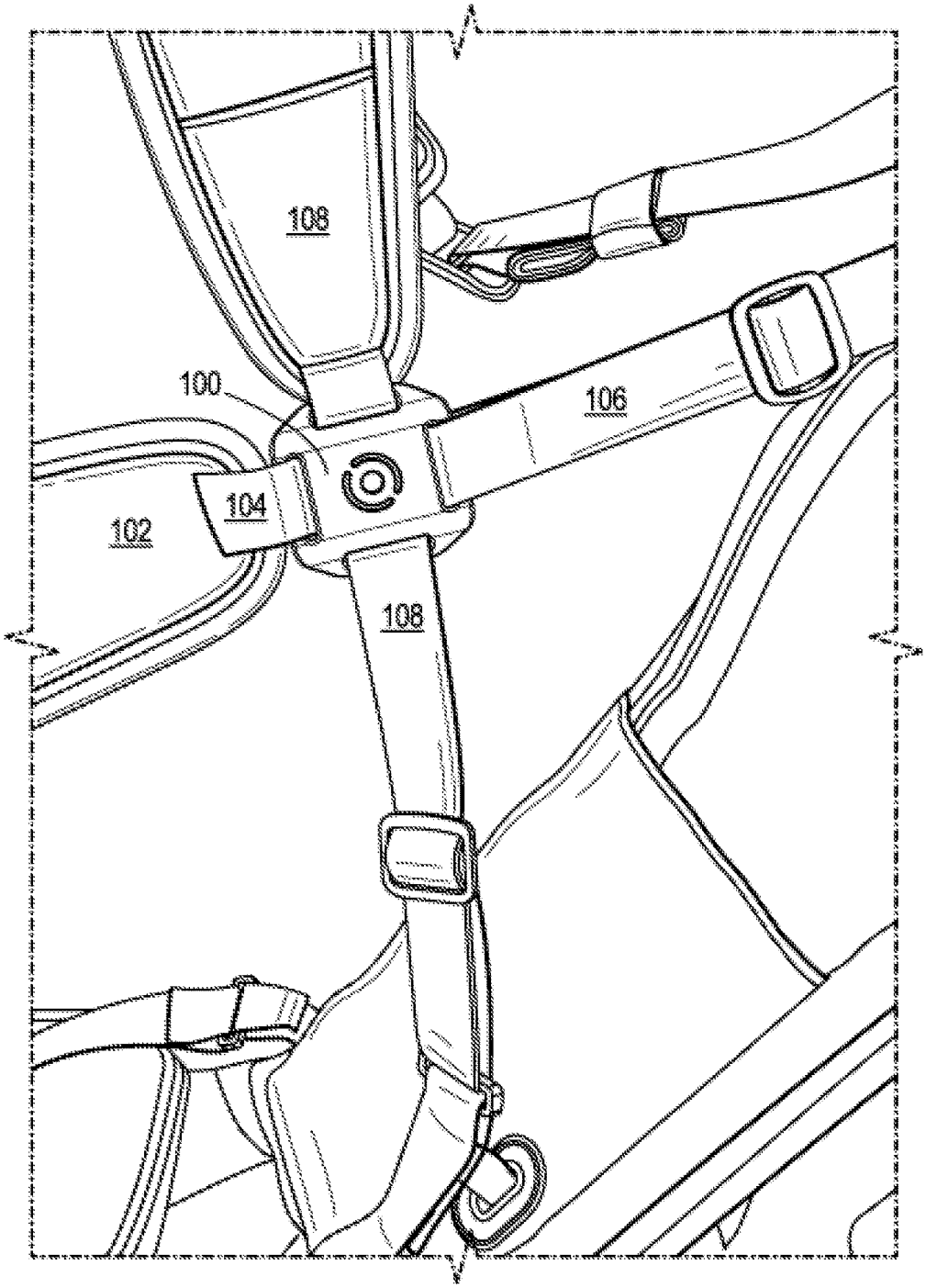
FIG. 1 shows a front view of a strap assembly system, according to a first embodiment.
Figure 12:
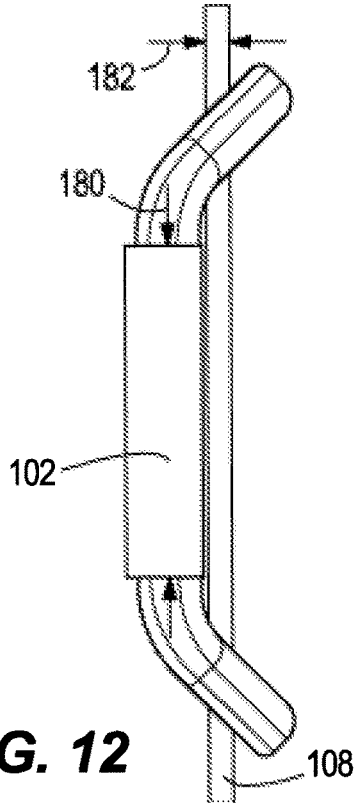
FIG. 12 shows the top view of FIG. 10, with the first and second strap of the strap assembly system shown.
Figure 13:
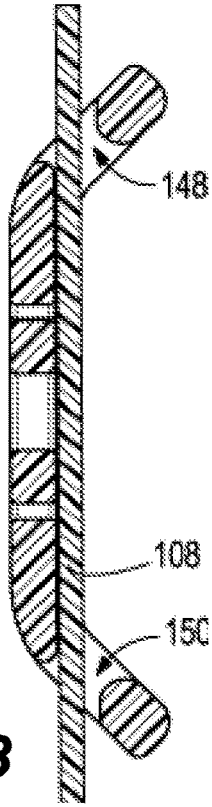
FIG. 13 shows the cross-sectional top view of FIG. 11, with the first and second strap of the strap assembly system shown.

As illustrated in FIGS. 1, 12, and 13, the first strap 102 can be discontinuous. The first strap 102 can comprise a first section 104 and a second section 106. The back puck 100 can be connected between the first section 104 and the second section 106 of the first strap 102. The first section 104 can comprise a first end and a first attachment end 110. The first end can be coupled to the golf bag. In some embodiments, the first end is coupled to a back of the golf bag, offset towards a right side of the golf bag. The first attachment end 110 can be coupled to the back puck 100. In some embodiments, the first attachment end 110 is permanently coupled, attached, sewn onto the back puck 100 and/or removably attached with snap-fit or other detachable coupling mechanisms. The second section 106 can comprise a second end and a second attachment end 112. The second end can be coupled to the golf bag. The second attachment end 112 can be coupled to the back puck 100. In some embodiments, the second attachment end 112 is permanently coupled, attached, sewn onto the back puck 100, and/or removably attached with snap-fit or other detachable coupling mechanisms. In some embodiments, the second end can be coupled to the back of the golf bag, offset towards a left side of the golf bag. In some embodiments, the first and second ends of the first strap 102 can be configured to be removable from the golf bag. In some embodiments, the first strap 102 further comprises a padded portion.

The discontinuity of the first strap 102 prevents the first strap 102 from rubbing against and creating friction with the second strap 108. The second strap 108 can slide freely through the back puck 100, without being hindered by the crossing of the first strap 102, which is attached to edges of the back puck 100. However, in some embodiments (not shown), the first strap 102 can be continuous, so long as the second strap 108 is positioned below the first strap 102 in a channel, so that the second strap 108 does not contact the first strap 102.

Figure 8:
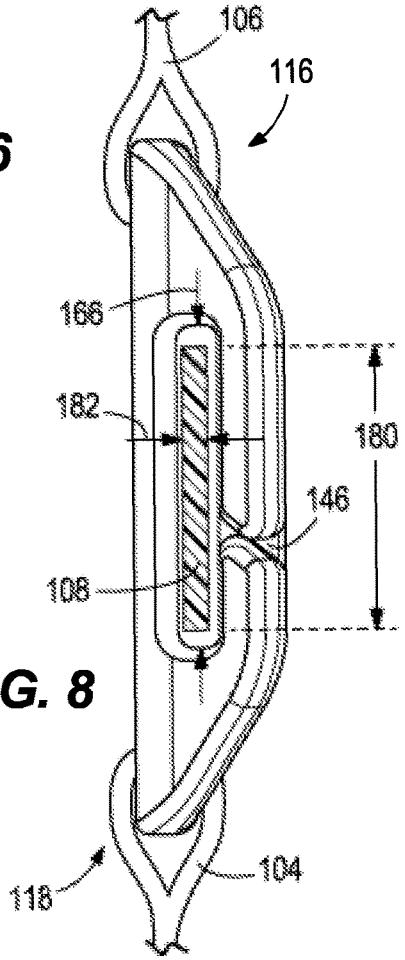
FIG. 8 shows the side view of FIG. 6, with a first and second strap of the strap assembly system shown.
Figure 9:
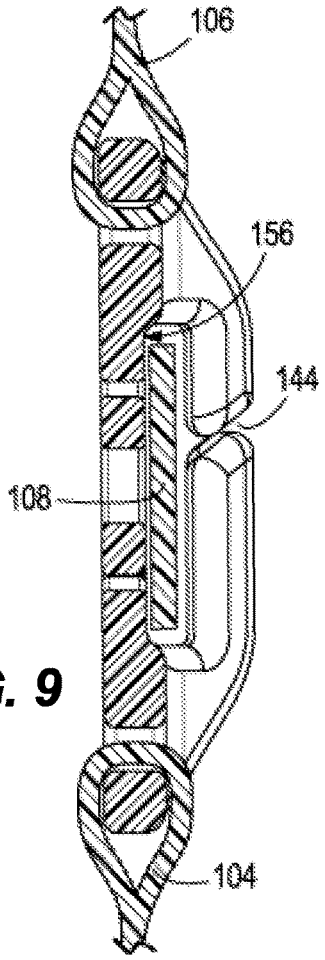
FIG. 9 shows the cross-sectional side view of FIG. 7, with the first and second strap of the strap assembly system shown.

The second strap 108 can be continuous. The second strap 108 can comprise a first end and a second end. The first and second end can be coupled to the golf bag. The first end of the second strap 108 can be coupled to the back of the golf bag, offset towards the left side of the golf bag. The second end of the second strap 108 can be coupled to the back of the golf bag, offset towards the right side of the golf bag. In some embodiments, the first and second ends of the second strap 108 can be configured to be removable from the golf bag. In some embodiments, the second strap 108 further comprises a padded portion. As illustrated in FIGS. 8 and 12, the first and second straps 102, 108 comprise a strap width 180 and a strap thickness 182.

Figure 2:
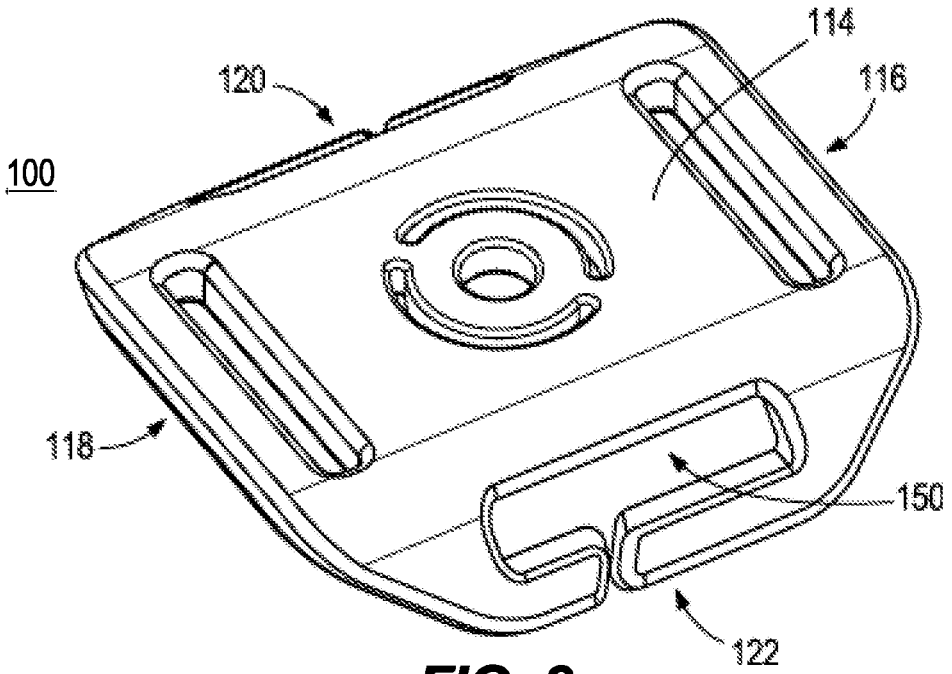
FIG. 2 shows a front perspective view of a back puck, according to an embodiment.

The back puck 100 can configure the first and second straps 102, 108. As illustrated in FIG. 2, the back puck 100 can comprise a central body 114, a first side 120, a second side 122, a front, and a rear. The central body 114 can comprise a top 116 and a bottom 118. The top 116 can comprise a first attachment opening 152 for receiving the first attachment end 110 of the first strap 102. The first attachment opening 152 can be cut from the central body 114 such that a plane extending through the first attachment opening 152 can be orthogonal to a plane extending through the central body 114. The bottom 118 can comprise a second attachment opening 154 for receiving the second attachment end 112 of the first strap 102. The second attachment opening 154 can be cut from the central body 114 such that a plane extending through the second attachment opening 154 can be orthogonal to a plane extending through the central body 114. In some embodiments, the first and/or second attachment end 112 of the first strap 102 can be looped through the first and/or second attachment opening 154 and secured back onto the first strap 102 by stitching. In some embodiments, the central body 114 of the back puck 100 can comprise a logo or emblem 190. The logo or emblem 190 can be embossed, printed, or cut through the central body 114. In the illustrated embodiment, the logo 190 is cut through the central body 114. The first and second sides 120, 122 of the back puck 100 can be configured to removably receive the second strap 108.

Figure 10:
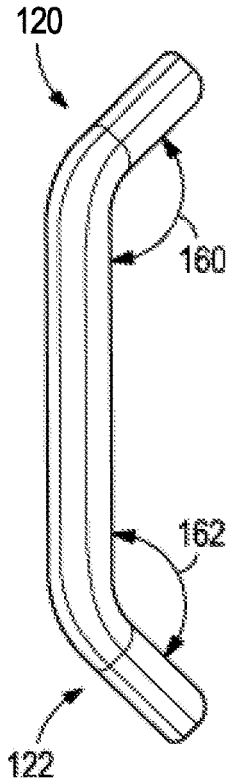
FIG. 10 shows a top view of the back puck of FIG. 2.

As illustrated in FIGS. 2, 4, and 10-13, the first side 120 and the second side 122 can be angled downward from the central body 114 towards the rear of the puck. In some embodiments, the first and second side 122 can be angled downward from the central body 114 at equal angles. As illustrated in FIG. 10, the first side 120 can be angled downward from the central body 114 at a first side angle 160 between 10 and 90 degrees. The second side 122 can be angled downward from the central body 114 at a second side angle 160 between 10 degrees and 90 degrees. The first side angle 160 and/or the second side angle 162 can be between 10 and 20 degrees, 20 and 30 degrees, 30 and 40 degrees, 40 and 50 degrees, 50 and 60 degrees, 60 and 70 degrees, 70 and 80 degrees, 80 and 90 degrees.

Figure 3:
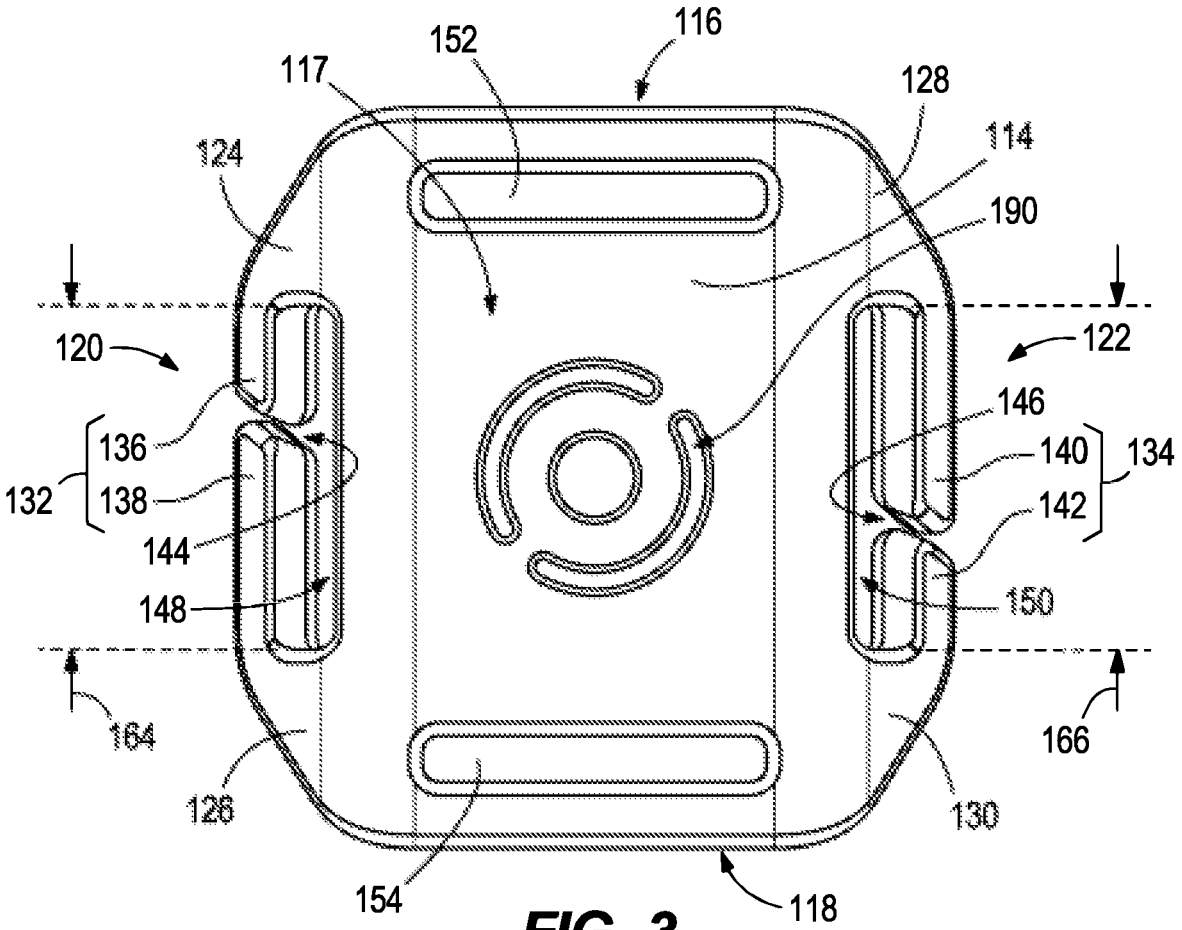
FIG. 3 shows a front view of the back puck of FIG. 2.
Figure 4:
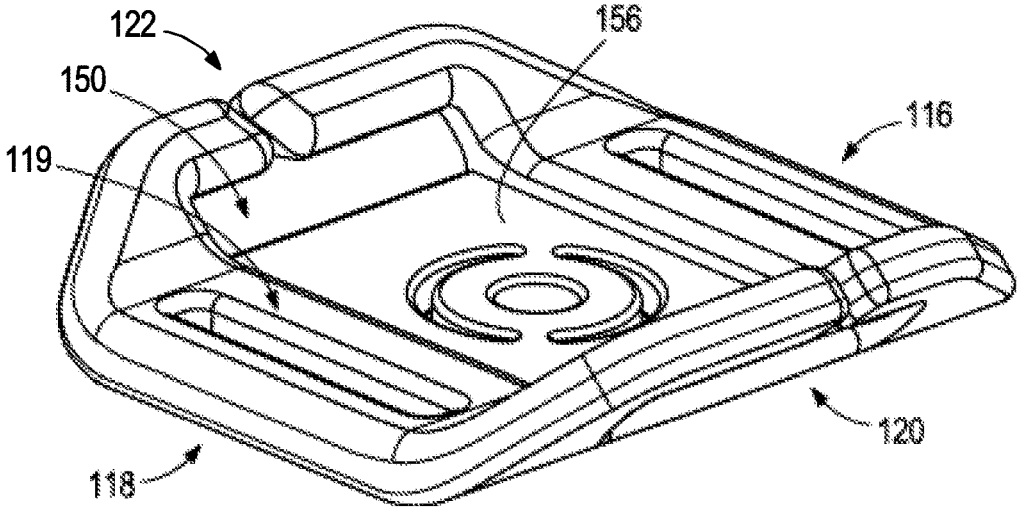
FIG. 4 shows a back perspective view of the back puck of FIG. 2.
Figure 5:
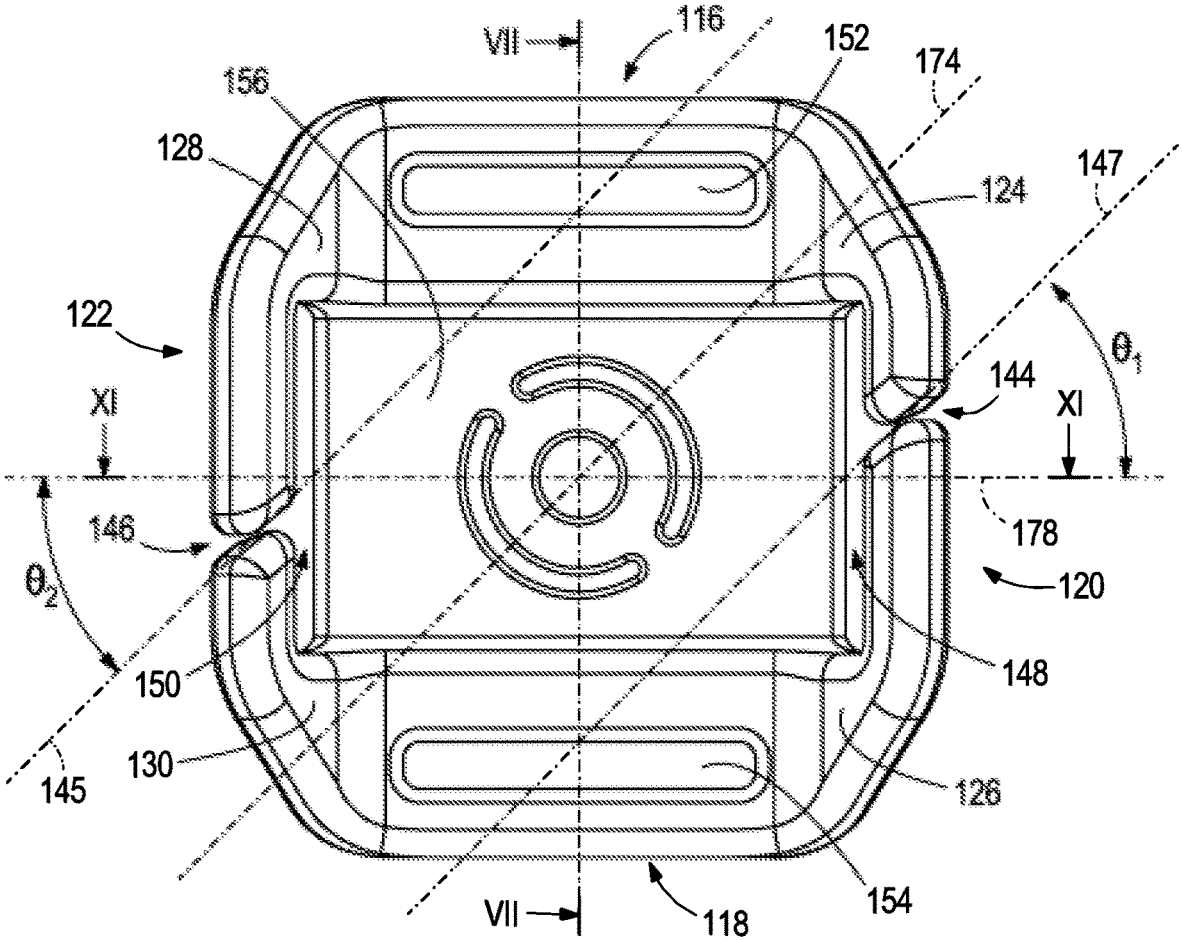
FIG. 5 shows a back view of the back puck of FIG. 2.

Referring to FIGS. 3 and 5, the first side 120 can comprise a first top corner 124, a first bottom corner 126, and a first arm 132. The first arm 132 can comprise a top first arm portion 136 and a bottom first arm portion 138. The first arm 132 can be discontinuous such that the space between the top first arm portion 136 and the bottom first arm portion 138 defines a first slit 144. The top first arm portion 136 can connect to and extend from the first top corner 124. The bottom first arm portion 138 can connect to and extend from the first bottom corner 138.

The second side 122 can comprise a second top corner 128, a second bottom corner 130, and a second arm 134. The second arm 134 can comprise a top second arm portion 140 and a bottom second arm portion 142. The second arm 134 can be discontinuous such that the space between the top second arm portion 140 and the bottom second arm portion 142 defines a second slit 146. The top second arm portion 140 can connect to and extend from the second top corner 128. The bottom second arm portion 142 can connect to and extend from the second bottom corner 130. The first slit 144 and the second slit 146 allow the second strap to be engaged or disengaged from the back puck 100. In other words, the first and second slits 144, 146 in the first and second arms 132, 134, respectively, allow the strap system to convert between the single-strap configuration and the double-strap configuration.

The first side 120 can define a first side opening 148, configured to receive the second strap 108. The first top corner 124, the first bottom corner 126, the first arm 132, and the central body 114 of the back puck 100 can form boundaries for the first side opening 148. The first arm 132 can define an outer edge of the first side opening 148. The first slit 144 can open into the first side opening 148. The second side 122 can define a second side opening 150, configured to receive the second strap 108. The second top corner 128, the second bottom corner 130, the second arm 134, and the central body 114 can form boundaries for the second side opening 150. The second arm 134 can define an outer edge of the second side opening 150, and the second slit 146 can open into the second side opening 150.

Figure 6:
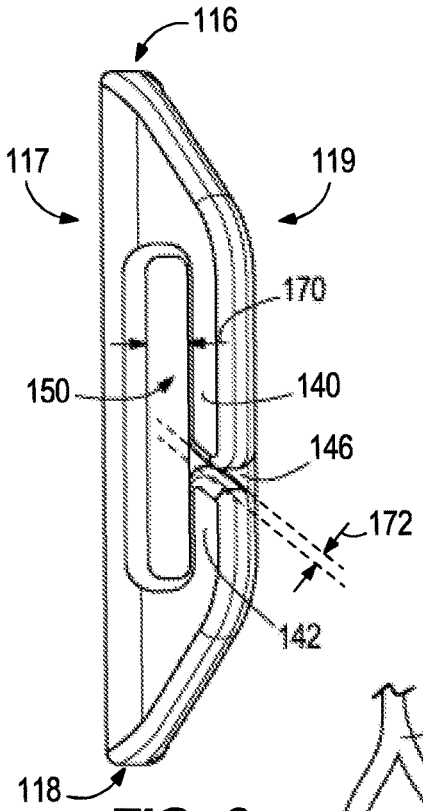
FIG. 6 shows a side view of the back puck of FIG. 2.
Figure 7:
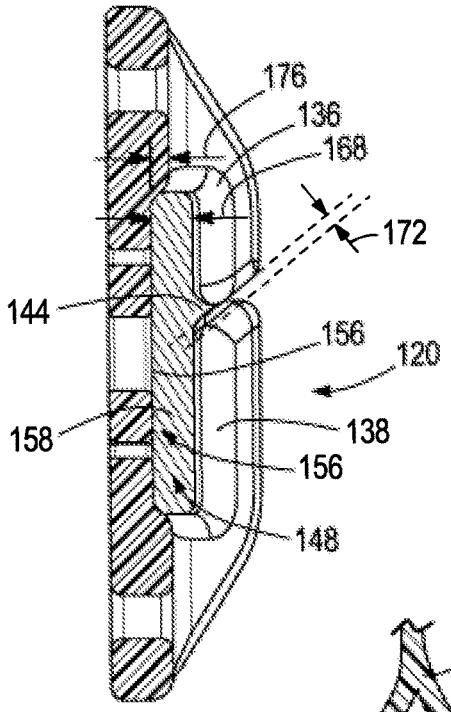
FIG. 7 shows a cross-sectional side view of the back puck of FIG. 2, taken along line VII-VII of FIG. 5.

Referring to FIGS. 3 and 7, the first side opening 148 comprises a first side opening width 164 and a first side opening height 168. Referring to FIGS. 3 and 6, the second side opening 150 comprises a second side opening width 166 and a second side opening height 170. The first side opening width 164 and the second side opening width 166 may be the same width. The first side opening height 168 and the second side opening height 170 may be the same height.

The first side opening width 164 and second side opening width 166 are in a range of 20 mm to 30 mm. The first side opening width 164 and second side opening width 166 can be between 20 mm and 22 mm, 22 mm and 24 mm, 24 mm and 26 mm, 26 mm and 28 mm, or 28 mm and 30 mm. In some embodiments, the first and/or second side opening widths 164, 166 can be 20 mm, 21 mm, 22 mm, 23 mm, 24 mm, 25 mm, 26 mm, 27 mm, 28 mm, 29 mm, or 30 mm. The first side opening width 164 and second side opening width 166 are greater than the second strap width 180. The first side opening height 168 and the second side opening height 170 are in a range of 2 mm to 8 mm. The first side opening height 168 and the second side opening height 170 can be between 2 mm and 3 mm, 3 mm and 4 mm, 4 mm and 5 mm, 5 mm and 6 mm, 6 mm and 7 mm, or 7 mm and 8 mm. In some embodiments, the first and/or second side opening heights 168, 170 can be 2 mm, 3 mm, 4 mm, 5 mm, 6 mm, 7 mm, or 8 mm.

Referring to FIGS. 3 and 6-8, the first side opening 148 and the second side opening 150 are sized to receive the second strap 108. The first and second side opening widths 164, 166 are greater than the second strap width 180. The first and second side opening heights 168, 170 are greater than the second side strap thickness 182. The first and second side opening widths 164, 166 and heights 168, 170 allow the second strap 108 to fit comfortably within and slide freely through the first and second side openings 148, 150. In other words, the first and second side opening widths 164, 166 and heights 168, 170 have values that allow the second strap 108 to move within the first and second side openings 148, 150 unhindered and unrestrained in the direction from the first side opening 148 to the second side opening 150. This free movement of the second strap 108 allows the golf bag to self-adjust to a user's posture when the strap system is in the double-strap configuration.

As illustrated in FIGS. 6 and 7, the first slit 144 and the second slit 146 comprise a slit width 172. The slit width 172 can be measured perpendicularly from a plane tangent to an end of the top arm portion 136 or 140 to a plane tangent to an end of the bottom arm portion 138 or 142, respectively. The slit width 172 is in a range of 0.5 mm to 5 mm. The slit width 172 can be between 0.5 mm and 0.7 mm, 0.7 mm and 0.9 mm, 0.9 mm and 1.1 mm, 1 mm and 1.5 mm, 1.5 mm and 2 mm, 2 mm and 3 mm, 3 mm and 4 mm, or 4 mm and 5 mm. In some embodiments, the slit width 172 can be 0.5 mm, 0.6 mm, 0.7 mm, 0.8 mm, 0.9 mm, or 1.0 mm. The slit width 172 is greater than the second strap thickness 182. The first slit 144 and second slit 146 allow for insertion and removal of the second strap 108 from the first side opening 148 and the second side opening 150, respectively.

As illustrated in FIGS. 6-9, in some embodiments, the first slit 144 can be closer to the top 116 than the bottom 118 of the back puck 100, and the second slit 146 can be closer to the bottom 118 than the top 116 of the back puck 100. The top first arm portion 136 can be shorter than the bottom first arm portion 138. The top second arm portion 140 can be longer than the bottom second arm portion 142. The position of the first slit 144 and the second slit 146 as defined by the lengths of the arm portions affects the ability of the back puck 100 to retain the second strap 108 without it slipping out when the golf bag is in the double-strap configuration.

Figure 16:
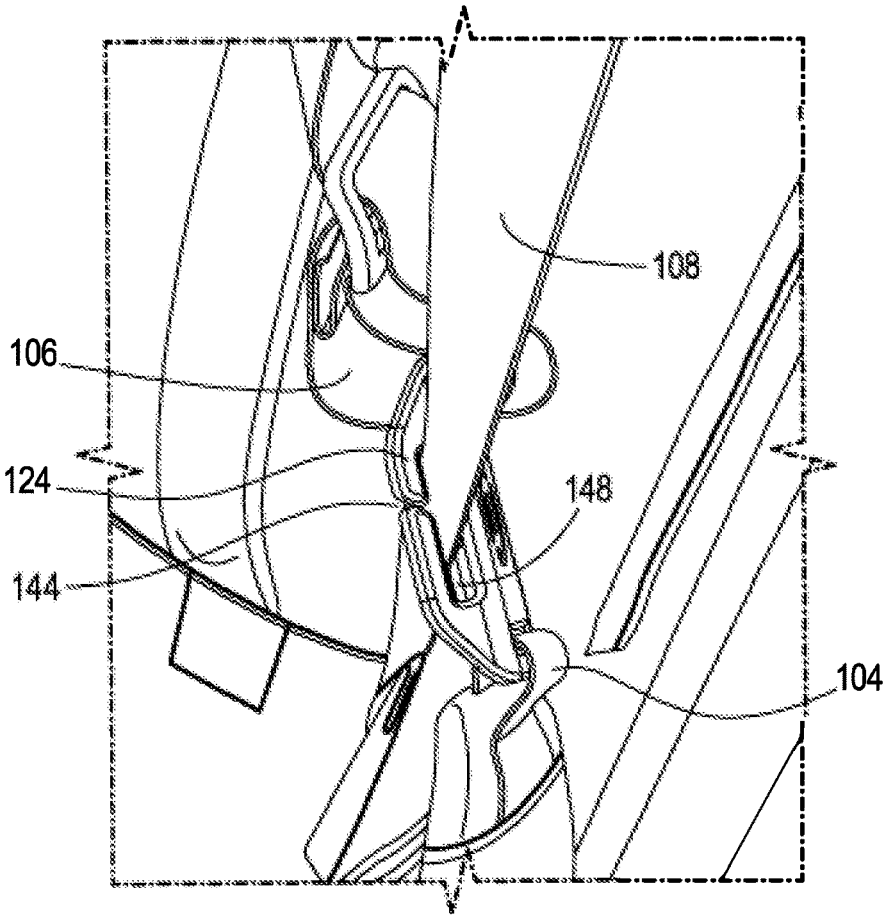
FIG. 16 shows a perspective view of the strap assembly system of FIG. 1 in a double-strap configuration.

As illustrated in FIG. 16, when the golf bag is lifted by the second strap 108 when in the double-strap configuration, the material of the second strap 108 can constrict within the first side opening 148 and the second side opening 150. Within the first side opening 148, the second strap 108 can constrict towards the first top corner 124 at the top 116 of the puck 100. The location of the first slit 144 closer to the top 116 (and the first top corner 124) than the bottom 118 (and the first bottom corner 126) can prevent an edge of the second strap 108 from slipping out when the strap 108 is bunched up. Within the second side opening 150, the second strap 108 can constrict towards the second bottom corner 130 at the bottom 118 of the puck 100. The location of the second slit 146 closer to the bottom 118 (and the second bottom corner 130) than the top 116 (and the second top corner 128) can prevent an edge of the second strap 108 from slipping out when the strap 108 is bunched up. Therefore, the lengths of the top first arm portion 136, bottom first arm portion 138, top second arm portion 140, and bottom second arm portion 142 can prevent the second strap 108 from slipping out through the first and second slits 144, 146. This security helps loosely retain the second strap 108 within the back puck, so that the second strap 108 is slidably connected to the first strap 102.

Referring to FIG. 5, the first and/or second slit 144, 146 can be angled with respect to the first and/or second arm 132, 134, respectively. In some embodiments, the first and/or second slit 144, 146 can be angled roughly parallel to a reference line 174 drawn from the first top corner 124 of the puck 100 to the second bottom corner 130 of the puck 100. In some embodiments, the first and/or second slit 144, 146 can comprise any angle suitable for insertion and removal of the second strap 108. In some embodiments, a longitudinal axis 178 is defined in a direction from the first side 120 to the second side 122, and centered between the top 116 and bottom 118 of the back puck, as taken from the rear view. A first slit reference line 145 runs parallel through the first slit, as taken from the rear view. A second slit reference line 147 runs parallel through the second slit, as taken from the rear view. The first slit 144 is angled at a first slit angle $\theta_1$, which is measured counterclockwise from the longitudinal axis 178 to the first slit reference line 145. The second slit 146 is angled at a second slit angle $\theta_2$, which is measured counterclockwise from the longitudinal axis 178 to the second slit reference line 147. The first slit angle $\theta_1$ can be equal to the second slit angle $\theta_2$. In some embodiments, the first slit angle $\theta_1$ and/or the second slit angle $\theta_2$ have a value of between 0 and 80 degrees. In some embodiments, the first slit angle $\theta_1$ and/or the second slit angle $\theta_2$ is between 0 and 10 degrees, 10 and 20 degrees, 20 and 30 degrees, 30 and 40 degrees, 40 and 50 degrees, 50 and 60 degrees, 60 and 70 degrees, or 70 and 80 degrees. The angulation of the first and second slits 144 and 146 helps prevent the second strap from inadvertently falling out of the back puck (exiting the first and/or second slit 144, 146) in the double-strap configuration, while also allowing the second strap to be quickly removed to convert the strap system to the single-strap configuration. The design of the first and second slits 144, 146 allows quick and versatile conversion and configuration of the strap system.

Figure 11:
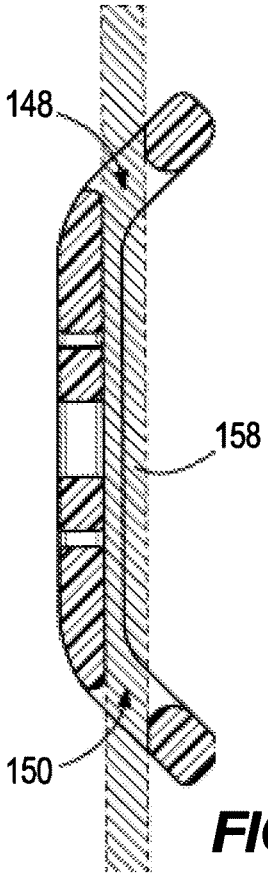
FIG. 11 shows a cross-sectional top view of the back puck of FIG. 2, taken along line XI-XI of FIG. 5.

The first side opening 148 and the second side opening 150 can be configured to removably receive the second strap 108 of the golf bag. As shown in FIGS. 7 and 11, a linear pathway 158 can extend through the first side 120 opening and the second side opening 150. In other words, the linear pathway comprises the space directly between the first side opening 148 and the second side opening 150. No part of the back puck 100 intersects the linear pathway. The pathway comprises a pathway width having the same width as the first side opening width 164 and second side opening width 166.

Referring to FIGS. 4, 5, 7, and 9, in some embodiments, a channel 156 can be cut into the central body 114. The channel 156 can run parallel to the linear pathway 158. In some embodiments, the linear pathway 158 runs through the channel 156. The channel 156 can extend from the first side opening 148 to the second side opening 150. The channel 156 can be as wide as the first side opening 148 and the second side opening 150. The channel 156 can be cut or recessed into the face of the central body 114, such that the plane of the channel 156 is parallel to the plane of the central body 114. The channel 156 can have a certain depth 176. The depth 176 of the channel 156 can be less than the thickness of the central body 114. In some embodiments, the channel depth 176 can be between 0 mm and 3 mm. In some embodiments, the channel depth 176 can be between 0 mm and 0.5 mm, 0.5 mm and 1 mm, 1 mm and 1.5 mm, 1.5 mm and 2 mm, 2 mm and 2.5 mm, or 2.5 mm and 3 mm. The first side 120 opening, second side opening 150, and the channel 156 of the back puck 100 are configured to allow free movement of the second strap 108 along the linear pathway 158.

In the single-strap configuration, the first strap 102 can be independent from the second strap 108. In other words, the second strap 108 can be disengaged from the back puck 100. The back puck 100 can be held and fixed between the first and second sections 104, 106 of the first strap 102.

In the double-strap configuration, the second strap 108 can be engaged with the back puck 100. The second strap 108 can run along the channel 156 and/or the linear pathway 158 cut through the central body 114 and bounded by the first side opening 148 and second side opening 150 of the back puck 100. The second strap 108 is configured to slide along the channel 156 having no bends, folds, or turns, and without resistance or clamping such that the second strap 108 is not fixed in position to the back puck 100 along the linear pathway 158 between first side opening 148 and the second side opening 150. The sliding movement of the second strap 108 allows the weight of the golf bag to be automatically distributed (self-adjusted) between both the first and second straps 102, 108 without the user adjusting the length of either strap. In the double-strap configuration, the back puck 100 restricts the second strap 108 to some degree in every direction other than the direction of the channel 156. By retaining the second strap 108 adjacent the first strap 102, the back puck 100 keeps the straps oriented in a configuration that (1) can be worn over both shoulders and (2) evenly distributes the weight of the golf bag.

In the double-strap configuration the first strap 102 and the second strap 108 can be oriented perpendicular to one another by the back puck 100. This crisscrossing setup of the first strap 102 and the second strap 108, connected by the back puck 100, allows the user to not only easily position the golf bag on his or her back, but also allows the user to walk and move without tangling or shifting the straps 102, 108 into an undesirable position.

Figure 14:
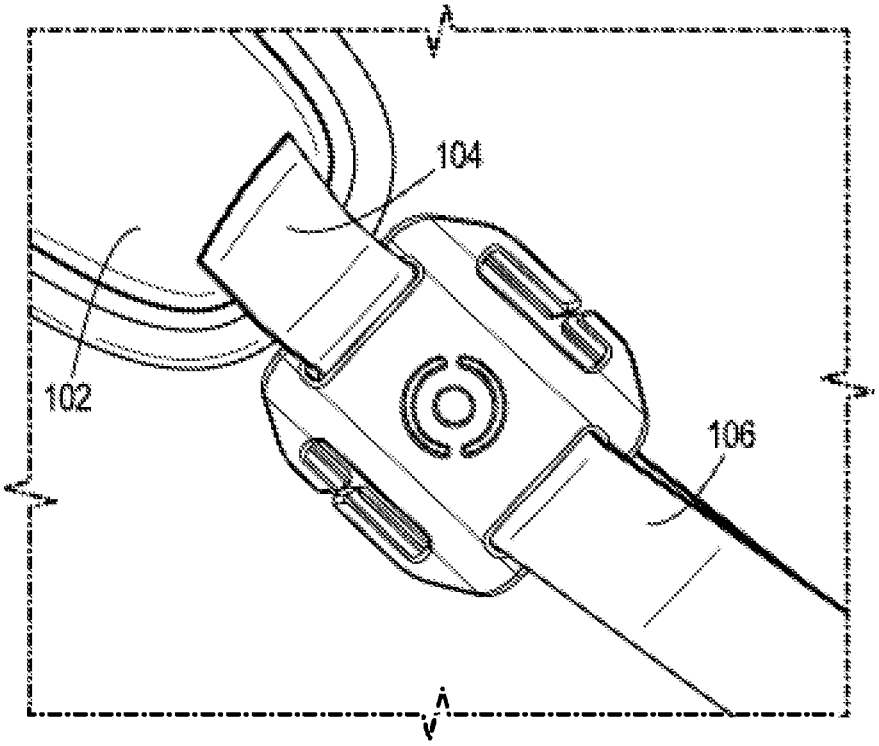
FIG. 14 shows a front view of the strap assembly system of FIG. 1 in a single-strap configuration.
Figure 15:
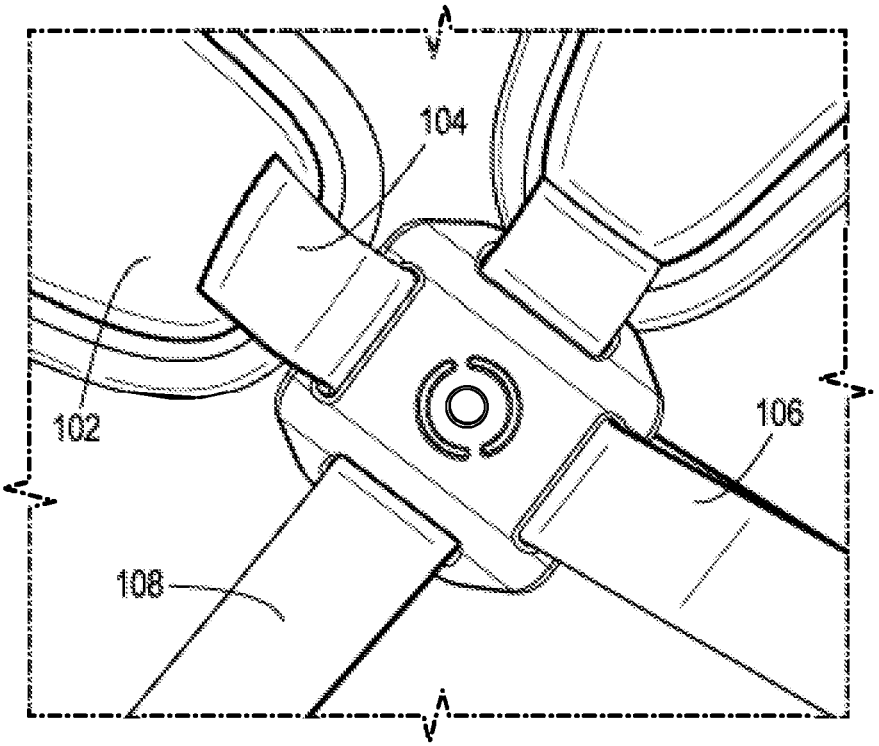
FIG. 15 shows a front view the strap assembly system of FIG. 1 in a double-strap configuration.
Figure 17:
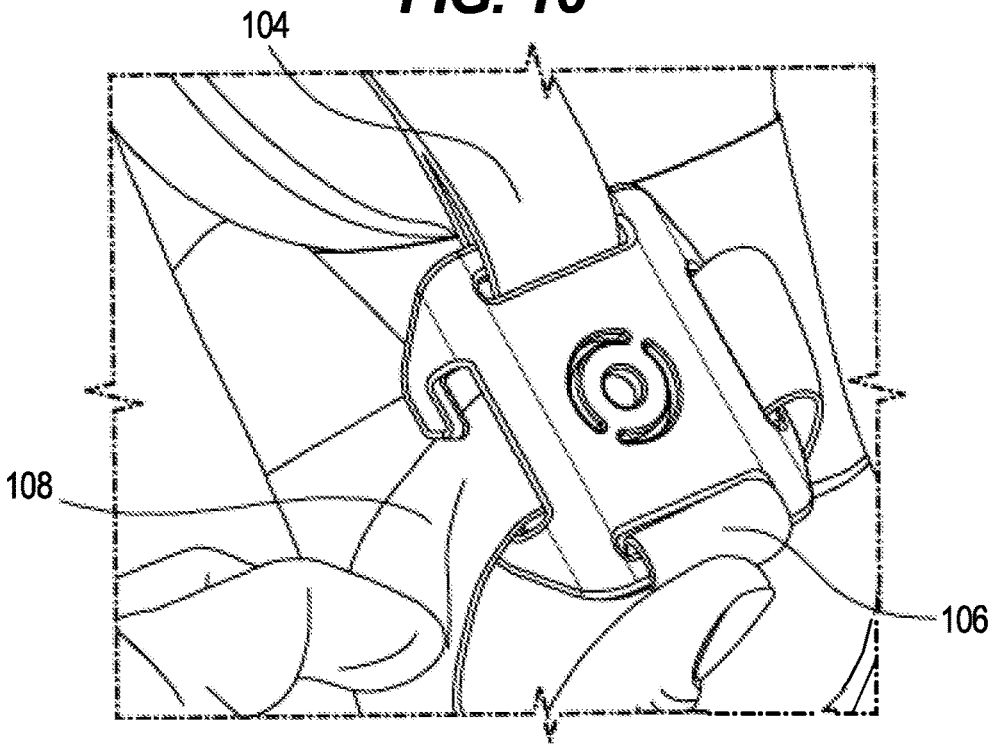
FIG. 17 shows a perspective view of the strap assembly system of FIG. 1 with the second strap partially inserted into a first side opening.

As described above, the strap assembly can be used in a single-strap configuration, such as is illustrate in FIG. 14, or in a double strap configuration, as illustrated in FIG. 15. To convert the strap assembly from the single-strap configuration to the double-strap configuration the second strap 108 is engaged with the back puck 100. Referring to FIG. 17, engaging the second strap 108 with the back puck 100 comprises inserting an edge of the second strap 108 into the first slit 144 on the first side 120 of the back puck 100. The second strap 108 can be then fed fully through the first slit 144 into the first side opening 148, which requires some temporary bunching of the second strap 108 material. The second strap 108 can be then allowed to spread out into the first side opening 148, and the first arm 132 holds the second strap 108 within the first side opening 148. Next, another portion of the second strap 108 can be inserted into the second slit 146 on the second side 122 of the back puck 100. The second strap 108 can be then fed fully through the second slit 146 and secured with the second side opening 150 in a manner similar to the insertion of the second strap 108 into the first side opening 148. The second arm 134 holds the second strap 108 within the second side opening 150. Upon completion of the insertion of the second strap 108 into the first and second side openings 148, 150, the second strap 108 can lie along the linear pathway 158 and experiences no resistance to motion along the linear pathway 158.

To convert the strap assembly from the double-strap configuration to the single-strap configuration, the second strap 108 can be disengaged by reversing the above insertion process. The second strap 108 can be pulled laterally through the first and/or second slit 144, 146 to remove the second strap from the first side opening 148 and/or the second side opening 150.

In some embodiments of the convertible strap system, the second strap 108 can be configured to be fully removable from the golf bag, allowing the user to configure the golf bag more permanently in a single-strap configuration. In these embodiments, the second strap 108 can be removed to simplify the bag, lighten the bag, and improve aesthetics.

The convertible strap system can provide the user with more versatility in how he or she carries the golf bag. The convertible strap system can reduce fatigue from carrying the golf bag by allowing the user to adapt the strap system to the user's needs. In addition, the convertible strap system provides a solution for caddies who desire to carry a golf bag by placing a single strap of each bag on each shoulder. Additionally, the convertible strap system is simple, requiring no tools for the conversion process between the single-strap and double-strap configuration. The method of engaging or disengaging the second strap 108 with the back puck 100 can be understood without detailed instructions. All these features make the convertible strap system an effective solution to the need in the art for a convertible strap system.

The invention claimed is:

1. A strap system for a golf bag comprising:
- a first strap comprising:
- a first section with a first end and a first attachment end, the first end coupled to the golf bag; and
- a second section with a second attachment end and a second end, the second end coupled to the golf bag;
- a second strap including a first and second end both coupled to the golf bag;
- a back puck comprising:
- a top comprising a first attachment opening;
- a bottom comprising a second attachment opening;
- a first side comprising a first arm having a first slit; and
- a second side comprising a second arm having a second slit;

wherein:
- the first side and the second side are configured to removably receive the second strap;
- the first side defines a first side opening, the first arm forming an edge of the first side opening;
- the second side defines a second side opening, the second arm forming an edge of the second side opening;
- the first attachment end of the first strap is coupled to the first attachment opening;
- the second attachment end of the first strap is coupled to the second attachment opening;
- the second strap is configured to fit within the first side opening and the second side opening along a linear pathway that extends through the first side opening and the second side opening;
- the second strap can freely move along the linear pathway;
- a channel extends from the first side opening to the second side opening, the linear pathway runs though the channel;
- the channel cuts into a central body along a rear of the back puck, such that a plane of the channel is parallel to a plane of the central body; and
- when in a double-strap configuration, the second strap is configured to slide along the channel, having no bends, folds, or turns, and without resistance or clamping, such that the second strap is not fixed in position to the back puck.

2. The strap system of claim 1, wherein:

the golf bag can be configured for carrying in a single-strap configuration or in a double-strap configuration; wherein:

the second strap is disengaged with the back puck in the single-strap configuration;

wherein:

the second strap is engaged with the back puck in the double-strap configuration;

the second strap is engaged with the back puck when the second strap extends through the first side opening and the second side opening along the linear pathway; and the second strap is fully removable from the golf bag when the strap system is in the single-strap configuration.

3. The strap system of claim 1, wherein:

the back puck further comprises a central body, a logo that is cut into the central body, a front, and the rear opposite the front;

the first attachment opening extends through the top of the back puck from the front to the rear;

a second attachment opening extends through the bottom of the back puck from the front to the rear;

a first side opening extends through the first side from the front to the rear; and a second side opening extends through the second side from the front to the rear.

4. The strap system of claim 1, wherein:

the first attachment end of the first strap is immovably coupled to the first attachment opening; and the second attachment end of the first strap is immovably coupled to the second attachment opening.

5. The strap system of claim 1, wherein:

the first side opening has a first side opening width;

the second side opening has a second side opening width;

the second strap has a strap width; and the first side opening width and the second side opening width are greater than the strap width.

6. The strap system of claim 1, wherein:

the first side opening has a first side opening height;

the second side opening has a second side opening height;

the first side opening height and the second side opening height are the same height;

the second strap has a strap thickness; and the first side opening height and the second side opening height are greater than the strap thickness.

7. The strap system of claim 6, wherein the first side opening height and the second side opening height have values within a height range selected from the group consisting of: 2 mm and 3 mm, 3 mm and 4 mm, 4 mm and 5 mm, 5 mm and 6 mm, 6 mm and 7 mm, and 7 mm and 8 mm.

8. The strap system of claim 1, wherein:

the first side and the second side are angled downward from a central body towards the rear.

9. The strap system of claim 8, wherein:

the first side and the second side are angled downward from the central body at equal angles;

the first side is angled downward at a first side angle, which is measured from a top view between the first side and the central body; and the second side is angled downward at a second side angle, which is measured from a top view between the second side and the central body.

10. The strap system of claim 9, wherein the first side angle and the second side angle have values within an angle range selected from the group consisting of: 10 and 20 degrees, 20 and 30 degrees, 30 and 40 degrees, 40 and 50 degrees, 50 and 60 degrees, 60 and 70 degrees, 70 and 80 degrees, and 80 and 90 degrees.

11. The strap system of claim 1, wherein the first slit is closer a first top corner of the back puck and the second slit is closer to a second bottom corner of the back puck.

12. The strap system of claim 1, wherein:

the second strap is removable through the first slit and the second slit to convert the strap system from a double-strap configuration to a single-strap configuration; and the second strap is insertable through the first slit and the second slit to convert the strap system from the single-strap configuration to the double-strap configuration.

13. A strap system for a golf bag comprising:

a first strap, discontinuously divided into a first section and a second section;

a second strap;

a back puck; the back puck comprising:

a central body, a top, a bottom opposite the top, a first side, a second side opposite the first side, a front, and a rear opposite the front; wherein the central body connects the top, bottom, first side, second side, front, and rear;

wherein:

when viewed from a top view, the first side and the second side are bent down to form a first side angle and a second side angle with a rear surface of the central body;

the first side angle and second side angle are equal;

the first side and second side are configured to removably receive the second strap;

the first section of the first strap is permanently fixed to a first attachment opening;

the second section of the first strap is permanently fixed to a second attachment opening; and, the first side opening, and the second side opening are configured to allow the second strap to slide unrestrained along a pathway that extends from the first side opening to the second side opening.

14. The strap system of claim 13, wherein:

the first side of the back puck comprises a first top corner a first bottom corner, and a first arm that forms a boundary of the first side opening and defines an outer edge of the first side opening;

the first arm is discontinuous;

the first arm comprises a top first arm portion and a bottom first arm portion, which are separated by a first slit;

the top first arm portion connects to and extends downwards from the first top corner;

the bottom first arm portion connects to and extends upwards from the first bottom corner;

the second side of the back puck comprises a second top corner, a second bottom corner, and a second arm that forms a boundary of the second side opening and defines an outer edge of the second side opening;

the second arm is discontinuous; and the second arm comprises a top second arm portion and a bottom second arm portion, which are separated by a second slit.

15. The strap system of claim 14, wherein:

the top first arm portion is shorter than the bottom first arm portion, causing the first slit to be located closer to the top than the bottom of the back puck;

the top second arm portion is longer than the bottom second arm portion, causing the second slit to be located closer to the bottom than the top of the back puck; and the positions of the first and second slits assist in retaining the second strap within the pathway.

16. The strap system of claim 14, wherein:

the first slit comprises a first slit width, measured perpendicularly from a plane tangent to an end of the top first arm portion to a plane tangent to an end of the bottom first arm portion;

the second slit comprises a second slit width, measured perpendicularly from a plane tangent to an end of the top second arm portion to a plane tangent to an end of the bottom second arm portion;

the second slit width is equal to the first slit width;

the second strap comprises a thickness; and the first and second slit widths are greater than the thickness of the second strap.

17. The strap system of claim 16, wherein:

the first and second slit widths have a value selected from the group consisting of between: 0.5 mm and 0.7 mm, 0.7 mm and 0.9 mm, 0.9 mm and 1.1 mm, 1 mm and 1.5 mm, 1.5 mm and 2 mm, 2 mm and 3 mm, 3 mm and 4 mm, and 4 mm and 5 mm.

18. The strap system of claim 14, wherein:

a reference line is defined diagonally from the first top corner to the second bottom corner of the back puck; and the first slit and the second slit are both angled roughly parallel to the reference line.

19. The strap system of claim 14, wherein:

a longitudinal axis is defined in a direction from the first side to the second side, and centered between the top and the bottom of the back puck, as taken from a rear view;

a first slit reference line runs parallel through the first slit, as taken from the rear view;

a second slit reference line runs parallel through the second slit, as taken from the rear view;

the first slit is angled at a first slit angle; the first slit angle measured counterclockwise from the longitudinal axis to the first slit reference line;

the second slit is angled at a second slit angle; the second slit angle measured counterclockwise from the longitudinal axis to the second slit reference line; and the first slit angle is equal to the second slit angle.

20. The strap system of claim 19, wherein the first slit angle and the second slit angle both have a value selected from the group consisting of between: 0 and 10 degrees, 10 and 20 degrees, 20 and 30 degrees, 30 and 40 degrees, 40 and 50 degrees, 50 and 60 degrees, 60 and 70 degrees, and 70 and 80 degrees.

* * * * *